United States Patent [19]

Clar

[11] Patent Number: 5,036,739

[45] Date of Patent: Aug. 6, 1991

[54] APPARATUS FOR TRIMMING CONTINUOUS SHEET

[76] Inventor: Milton Clar, 11801 Rockville Pike #705, Rockville, Md. 20852

[21] Appl. No.: 550,537

[22] Filed: Jul. 10, 1990

[51] Int. Cl.[5] ..... B41J 11/68

[52] U.S. Cl. ..... 83/422; 83/423; 83/425; 83/856

[58] Field of Search ..... 225/100, 94, 7, 104, 225/105, 99, 3, 89; 83/856, 858, 422, 423, 425

[56] References Cited

U.S. PATENT DOCUMENTS

| | | | |
|---|---|---|---|
| 3,056,324 | 10/1962 | Lach | 83/423 |
| 4,094,217 | 6/1978 | Exline | 83/6 |
| 4,831,909 | 5/1989 | Peters et al. | 83/425.4 |
| 4,940,347 | 7/1990 | Lund | 400/621.1 |

FOREIGN PATENT DOCUMENTS

| | | | |
|---|---|---|---|
| 3137766 | 4/1983 | Fed. Rep. of Germany | 225/7 |
| 2556654 | 6/1985 | France | 225/99 |

*Primary Examiner*—Frank T. Yost
*Assistant Examiner*—John M. Husar
*Attorney, Agent, or Firm*—Epstein, Edell & Retzer

[57] ABSTRACT

Apparatus for trimming a lateral edge of a moving continuous sheet including a hold down plate selectively movable to positions spaced from the lateral edge of the sheet and covering the lateral edge, a cutting blade carried on the hold down plate selectively movable between an inoperative position within or above hold down plate to an operative position extending beneath the hold down plate to trim the lateral edge of the sheet as the sheet moves past the cutting blade and a latch mechanism locking the cutting blade in the operative position and responsive to movement of the hold down plate to the spaced position to unlock the cutting blade to permit the cutting blade to automatically return to the inoperative position.

15 Claims, 2 Drawing Sheets

APPARATUS FOR TRIMMING CONTINUOUS SHEET

BACKGROUND OF THE INVENTION

1. Field Of The Invention

The invention pertains to apparatus for trimming at least one lateral edge of an advancing continuous sheet and, more particularly, to apparatus for continuously trimming the apertured lateral edges of continuous sheet print medium in a printer.

2. Description Of The Prior Art

Print medium for high-speed line printers typically includes a continuous sheet of imprintable material, such as paper, fed from a paper supply roll or folded pack and advanced through a printer by drive tractors having peripheral teeth for engaging pre-formed spaced apertures linearly disposed along the lateral edges of the sheet. As the sheet is advanced through the printer, alphanumeric characters reflecting stored data, such as from a computer, are printed on the main body of the sheet as hard copy output. Typically, the apertured lateral edges of the sheet are separated from the main body of the sheet by a linear perforation extending parallel to the lateral edges for allowing the lateral edges to be separated from the main body by manually tearing along the perforations after the sheet has exited the printer. The process of separating the lateral edges of the sheet from the main body by hand is very tedious and time consuming. Care must be taken to avoid tearing or otherwise damaging the main body of the sheet to preserve the readability and clarity of the imprinted data. Moreover, the manual tearing process becomes even more difficult when large volumes of print-out are involved and is incompatible with the high-speed characteristics of state of the art line printers.

Although devices for trimming the side edges of computer print-out sheet have been proposed, such devices possess numerous drawbacks and limitations. For example, U.S. Pat. No. 2,311,051 discloses a strip feeding attachment for a tabulating machine including a slitter blade held by a setscrew in a clamped position engaging an advancing strip of material to slit the feed bands from the main body of the strip. Various other devices for trimming at least one of the lateral edge of a continuously advancing sheet of material are shown in U.S. Pat. Nos. 4,611,518 to Hildebrandt, 4,572,686 to Tanaka, 4,423,975 to Krenz and 3,937,377 to Schueler.

Prior art edge trimmers fail to satisfy the requirements for an effective, safe, selectively operable trimmer that can be inexpensively produced and easily installed or retrofitted on printers. To this end, prior art edge trimmers, as exemplified by the above patents, have the disadvantages of having relatively complex mechanisms that are extremely difficult, if not impossible, to install on printers of the type commonly used with computers, of being expensive to manufacture and of being bulky and requiring substantial space as well as presenting exposed cutting members.

SUMMARY OF THE INVENTION

Accordingly, it is a primary object of the present invention to provide apparatus for trimming a lateral edge of a continuously advancing sheet overcoming the above described disadvantages of the prior art.

Another object of the present invention is to trim at least one of the apertured lateral edges of a sheet advanced by a drive tractor through a line printer by mounting a cutting blade on a hold down plate disposed on the drive tractor.

It is also an object of the present invention to install a cutting blade on a printer for trimming a lateral edge of a continuously advancing printed sheet in a manner to bias the cutting blade to an inoperative position and to lock the cutting blade in an operative position.

Still another object of the present invention is to mount cutting blades for trimming lateral edges of a continuously advancing sheet on the hold down plates of a printer to be selectively operable.

A further object of the present invention is to lock a cutting blade for trimming a lateral edge of a continuously advancing sheet in an operative exposed position relative to a movable hold down plate selectively engagable with the lateral edge of the sheet and to release the cutting blade to return to an inoperative position in response to movement of the hold down plate away from the sheet. The trimming apparatus of the present invention is generally characterized in a cutting blade movably received in a support housing carried on a hold down plate pivotally mounted adjacent the lateral edge of a moving continuous sheet for selective movement to a position covering a portion of the lateral edge to retain and guide the edge as the sheet is continuously moved beneath the hold down plate by a drive tractor engaging a series of pre-formed linearly arranged apertures along the lateral edge of the sheet. A spring disposed around the cutting blade urges the cutting edge of the blade to an inoperative position within or above the hold down plate. An actuating push-button on the cutting blade in engagement with the spring permits the cutting blade to be selectively moved within the support housing in opposition to the spring bias to an operative position extending from the hold down plate to contact and sever the lateral edge of the sheet as the sheet is moved by the drive tractor beneath the hold down plate. A latch spring member held within a slot in the support housing is urged against the cutting blade, and a notch in the cutting blade is in alignment with the slot when the cutting edge is in the operative position to receive the latch spring member and lock the cutting edge in the operative position. When the hold down plate is pivoted away from the lateral edge of the sheet, the latch spring member is moved out of the notch in the cutting blade to allow the cutting edge to return to the protected inoperative position within the hold down plate and support housing under the restoring force of the bias spring.

Some of the advantages of the present invention over the prior art are that the cutting blade is mounted on the hold down plate above a drive tractor to produce, sever or trim the lateral edge from the sheet while the sheet is positively held to facilitate the cutting action, the trimming apparatus has relatively few parts and is simple to install and inexpensive to produce, the cutting blade automatically retracts to a protected, inoperative position when the hold down plate is moved away from the sheet to allow handling of the sheet with no exposed cutting edges, and the trimming apparatus is selectively operable in a simple, easy to use manner.

BRIEF DESCRIPTION OF THE DRAWINGS

The above and still further objects, features and advantages of the present invention will become apparent upon consideration of the following detailed description of the preferred embodiment when taken in conjunction with the accompanying drawings, wherein like reference numerals in the various figures are utilized to designate like components, and wherein.

DESCRIPTION OF THE PREFERRED EMBODIMENT

Figure 1:
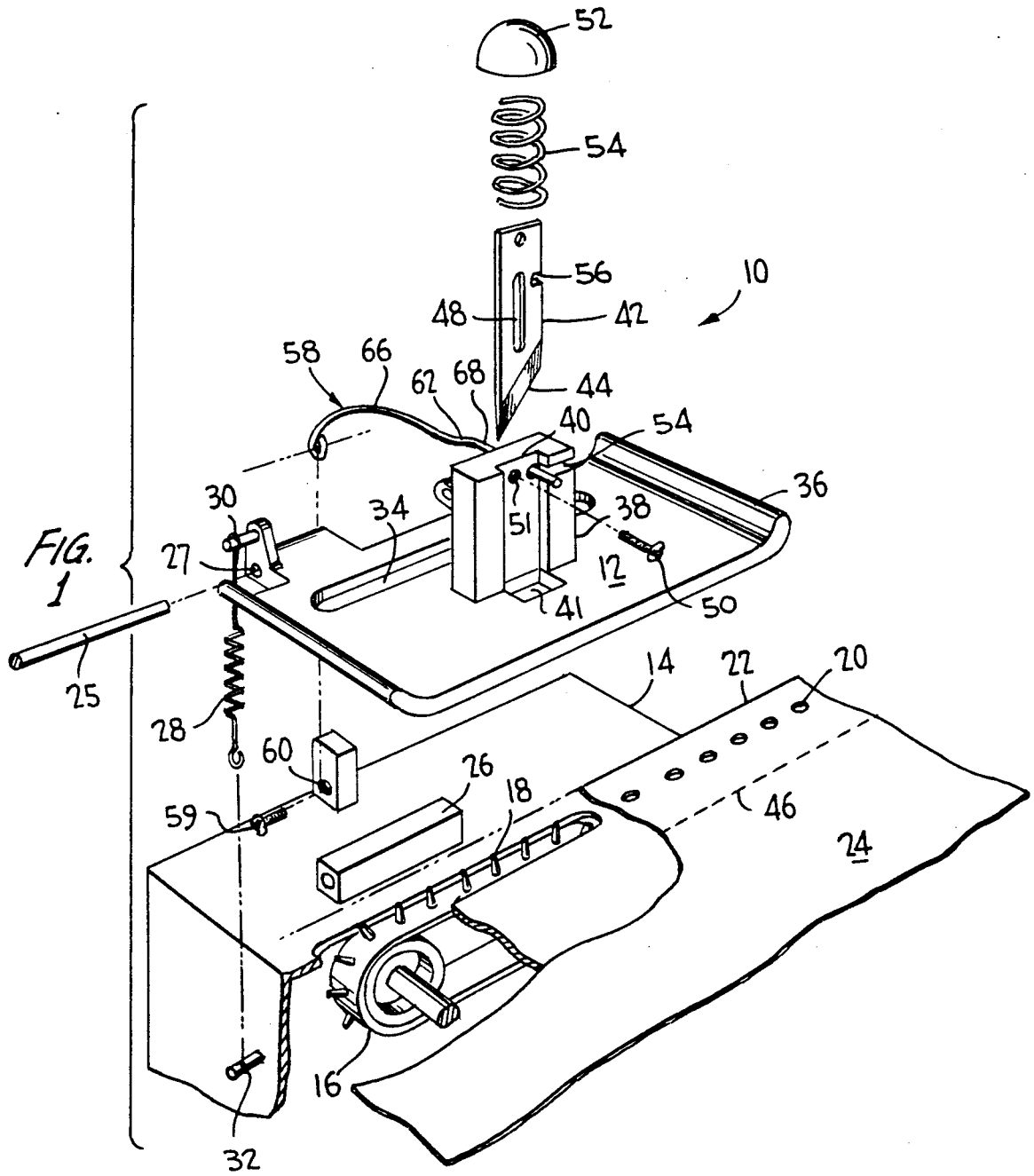
FIG. 1, is a broken exploded view in perspective of the trimming apparatus of the present invention.
Figure 2:
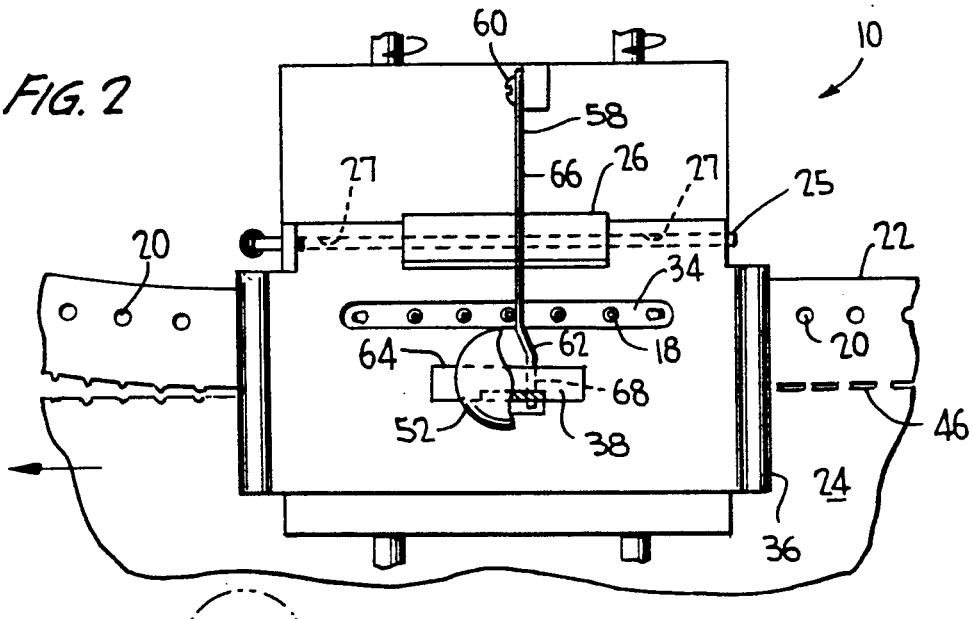
FIG. 2 is a top plan view of the trimming apparatus of the present invention.
Figure 3:
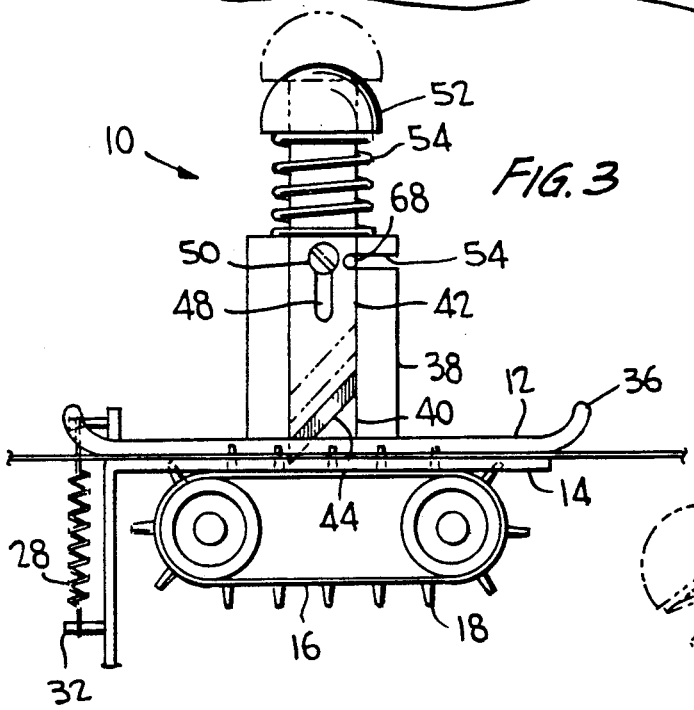
FIG. 3 is a side view of the trimming apparatus of the present invention with the inoperative position for the cutting blade shown in phantom.
Figure 4:
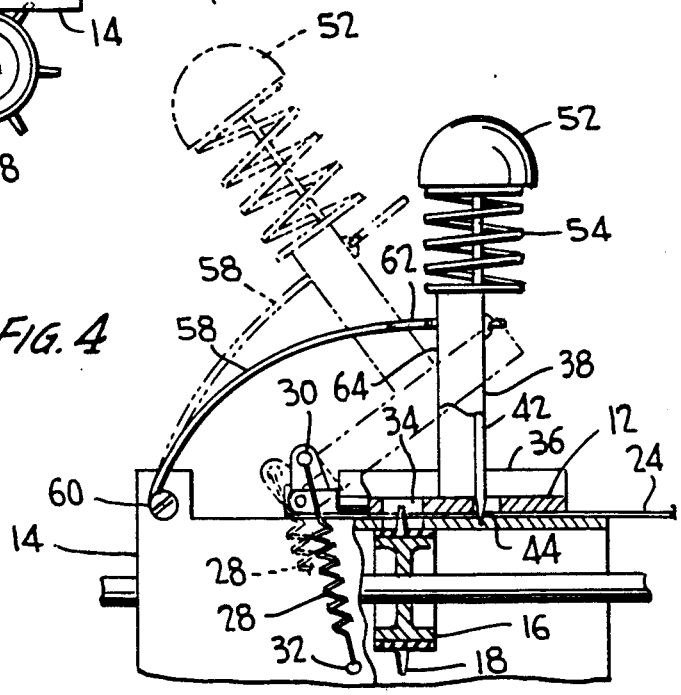
FIG. 4 is an end view partly in section of the trimming apparatus of the present invention with the sheet releasing position for the hold down plate shown in phantom.

The trimming apparatus 10 of the present invention is shown in FIGS. 1–4 and includes a hold down plate 12 pivotally mounted on a stationary support 14 for a drive tractor 16 having peripheral teeth 18 for engaging preformed linearly arranged spaced apertures 20 disposed parallel to a lateral edge 22 of a continuous sheet 24 moved forwardly upon the support by the drive tractor 16. Hold down plate 12 is pivotally mounted on support 14 via a shaft 25 extending parallel to the lateral edge 22 of the sheet 24 and passing through a bore in a block 26 on support 14 and through bores 27 in the outer edges of the hold down plate which is notched to receive block 26. One end of a coil spring 28 is secured to a pin 30 on the hold down plate 12, and the opposite end of the spring 28 is secured to a pin 32 on the support 14 to tension the spring. Hold down plate 12 pivots around shaft 25 from a spaced sheet releasing position wherein the lateral edge 22 of the sheet 24 is uncovered, as shown in phantom in FIG. 4, to a covered position wherein the hold down plate 12 extends over and covers the lateral edge 22, as shown in FIGS. 2, 3, and 4. Spring 28 urges the hold down plate 12 into close contact with the sheet 24 to guide and retain the lateral edge 22 while allowing the edge 22 to move beneath the hold down plate 12 as the sheet 24 is advanced by the drive tractor 16. An opening 34 is formed in hold down plate 12 spaced from pivot shaft 25 and parallel thereto to receive the teeth 18 of the drive tractor 16 as the drive belt rotates to continuously move the sheet. The hold down plate 12 extends from opening 34 inwardly toward the center of the sheet 24 and has angled lips 36 allowing the hold down plate 12 to be manually grasped for selective pivotal movement to the positions covering and uncovering the lateral edge 22 of sheet 24. The hold down plate as thus far described is conventionally provided on printers for cooperation with sheet drive tractors, and the configuration shown is exemplary only in that hold down plates can be of various configurations, such as flat or curved.

An upstanding support housing 38 is carried on the upper surface of the hold down plate 12 disposed inwardly from opening 34. Support housing 38 extends perpendicular to the hold down plate 12, and a vertically oriented channel 40 is formed through housing 38 in alignment with an opening 41 in hold down plate 12 to define a passage along the housing and through the hold down plate extending perpendicular to the sheet 24 beneath the hold down plate. A flat cutting blade 42 is slidably received in channel 40 and carries an angled cutting edge 44 on the lower end thereof. The cutting blade 42 is constrained to move in the passage formed by channel 40 and opening 41 to be disposed inwardly of apertures 20, and sheet 24 can have a pre-formed perforated line 46 with which the cutting edge 44 is aligned to sever the apertured lateral edge 22 from the main body of sheet 24 along perforation 46. A vertically oriented, elongated aperture 48 is formed in cutting blade 42, and a screw 50 extends through aperture 48 and through a hole 51 in housing 38 to secure cutting blade 42 within channel 40. Aperture 48 in cutting blade 42 permits the cutting blade 42 to slide upwardly and downwardly in channel 40 in a plane perpendicular to the hold down plate 12 and, therefore, sheet 24. The upper end of the cutting blade projects from housing 38, and an enlarged push-button 52 is mounted on the upper end of the cutting blade 42. A coil spring 52 is disposed around the cutting blade 42 and is held in compression between push-button 52 and housing 38 to bias the cutting blade 42 upwardly within channel 40 to the inoperative position depicted in phantom in FIG. 3 wherein cutting edge 44 is contained within channel 40 and, therefore, protected by hold down plate 12 and housing 38 to be shielded from incidental contact with persons or objects that could result in injury or damage thereto. Push-button 52 permits the cutting blade to be manually pushed downwardly within channel 40 to the operative trimming or severing position shown in FIGS. 3 and 4 where the cutting edge 44 projects beneath the hold down plate 12 to contact the sheet 24 as the sheet moves beneath the hold down plate 12. Preferably, cutting edge 44 is angled, to face the approaching sheet 24 to continuously sever the apertured lateral edge 22 as the sheet is moved past the angled cutting edge 44 by the drive tractor 16.

A slot-like opening 54 is disposed in an end wall of housing 38 and extends into channel 40. A notch-like recess 56 is formed in the side of cutting blade 42 adjacent slot 54 and is positioned to be aligned with slot 54 when push-button 52 has been depressed to extend cutting edge 44 beneath hold down plate 12. A latch spring member 58 is pivotally secured to support 14 via a screw 59 at block 60 to be laterally displaced or offset from pivot shaft 25. Latch spring member 58 curves upwardly from the end secured to support 14 at block 60 over hold down plate 12 to extend through slot 54 in block 38. Latch spring member 58 is configured to be biased or urged into slot 54 to extend into channel 40 in the path of sliding movement for the cutting blade 42. Thus, when the cutting blade 42 is moved downwardly within channel 40 via the push-button 52 to extend the cutting edge 44, notch 56 will be aligned with slot 54, and latch spring member 58 will automatically enter notch 56 to engage the cutting blade 42 to lock the cutting edge 44 in the extended, operative position.

Latch spring member 58 includes an integral cam or bend 62 located adjacent a side wall 64 of housing 38 facing pivot shaft 26. As shown in FIG. 2, bend 62 extends from a main body 66 of the latch spring member 58 toward side wall 64 of block 38 in the direction of slot 54 at an angle with respect to the vertical plane containing the main body 66. Bend 62 is joined to a straight blade engaging end 68 of the latch spring member 58 exteriorly of side wall 64 at an angle such that the vertical plane containing blade engaging end 68 is parallel to and offset from the vertical plane containing main body 66. As shown in FIG. 4, the configuration of the latch spring member is such that, when the hold down plate 12 is pivoted around pivot shaft 26 to uncover and release sheet 24, latch spring member 58 pivots with blade engaging end 68 retained in and notch 56; and, once the side wall 64 of housing engages bend 62, the blade engaging end 68 is cammed out of notch 56.

In operation, the pre-formed apertures 20 along the lateral edges 22 of a continuous sheet 24, such as paper, are placed in engagement with the teeth 18 on the drive tractors for movement through the printer. Hold down plate 12 is pivoted around pivot shaft 26 to a position covering and retaining each lateral edge 22 of the sheet 24. Tensioned spring 28 urges the hold down plate 12 toward the sheet 24 while allowing the sheet 24 to move beneath the hold down plate 12 when drive tractor 16 is rotated, and opening 34 in hold down plate 12 extends over the teeth 18 of the drive tractor 16 to permit free rotation of the drive tractor. Spring 53, acting against block 38 and push-button 52, urges cutting blade 42 upwardly within channel 40 to an inoperative position with cutting edge 44 disposed in channel 40 to prevent injury or damage caused by accidental contact with the cutting edge 44.

When it is desired to place the cutting edge 44 in an operative position for severing or trimming the apertured lateral edge 22 of sheet 24, push-button 52 is manually depressed to move cutting blade 42 downwardly in channel 40 and extend cutting edge 44 beneath hold down plate 12 to contact sheet 24. Extension of cutting edge 44 to the operative position corresponds with alignment of notch 56 on cutting blade 42 with slot 54 in housing 38. Because the blade engaging end 68 of the latch spring 58 contained in slot 54 is urged in the direction of the cutting blade 42 into channel 40, the blade engaging end 68 automatically engages notch 56 to lock the cutting blade 42 in the operative position. Accordingly, as the sheet 24 is moved past the angled cutting edge 44, the apertured lateral edge 22 is severed from the sheet inwardly of apertures 20. In instances where the sheet 24 includes a perforated line 46 for tearing off the apertured lateral edge, the cutting edge 44 is positioned to sever the lateral edge along the perforation.

When it is desired to move the hold down plate 12 to a position uncovering and releasing the lateral edge 22 of the sheet 24, lip 36 is manually grasped, and hold down plate 12 is pivoted upwardly around pivot shaft 25. As the hold down plate 12 is pivoted to the sheet releasing position, latch spring member 58 pivots therewith around pivot point 60, and cam 62 on latch spring member 58 is contacted by the side wall 64 of housing 38 to push the blade engaging end 68 of latch spring member 58 out of notch 56 in the cutting blade 42 and out of channel 40. When the blade engaging end 68 of latch spring member 58 is disengaged from notch 56 and channel 40, spring 53 automatically retracts the cutting blade 42 to an upward location within channel 40 corresponding to the inoperative position for cutting edge 44. The blade engaging end 68 of latch spring 58 remains in slot 54 biased against the cutting blade 42 until such time as the cutting blade 42 is again moved to the operative position to allow the blade engaging end 68 to automatically return to a position within channel 40 and, therefore, notch 56 of the cutting blade 42.

Although the trimming apparatus has been shown and described in conjunction with one of the lateral edges of a continuous sheet, a trimming apparatus will normally be provided for each of the lateral edges of a continuous sheet to simultaneously cut both edges.

Inasmuch as the present invention is subject to many variations, modifications and changes in detail, it is intended that all subject matter discussed above or shown in the accompanying drawings be interpreted as illustrative only and not to be taken in a limiting sense.

What is claimed is:

1. Apparatus for trimming a lateral edge of an advancing continuous sheet comprising cutting means selectively movable between an inoperative position disposed above the lateral edge of the sheet to an operative position in the path of the lateral edge for trimming the lateral edge;

latch means movable independently of said cutting means responsive to movement of said cutting means to said operative position for engaging and locking said cutting means in said operative position, said latch means being disengagable from said cutting means; and means for moving said cutting means to said inoperative position responsive to said latch means being disengaged from said cutting means.

2. Apparatus as recited in claim 1 further comprising a support housing and wherein said cutting means includes a cutting blade slidably disposed in said support housing.

3. Apparatus as recited in claim 2 wherein said cutting blade is slidable in a direction perpendicular to the direction of sheet advancement.

4. Apparatus as recited in claim 3 further including actuating means coupled with said cutting blade for moving said cutting means to said operative position.

5. Apparatus as recited in claim 4 wherein said means for moving said cutting means to said inoperative position includes spring means disposed between said actuating means and said support housing.

6. Apparatus as recited in claim 5 wherein said support housing has an opening therein, said latch means includes a member disposed in said opening and biased toward said cutting blade, and said cutting blade includes notch means in alignment with said opening when said cutting means is in said operative position for receiving said latch member.

7. Apparatus as recited in claim further comprising a support housing for said cutting means and wherein said latch means includes a spring member movably mounted to engage said support housing and said cutting means to lock said cutting means in said operative position.

8. Apparatus as recited in claim 7 wherein said support housing is movable away from the sheet and said latch means includes means responsive to movement of said support housing away from the sheet to disengage said spring member from said cutting means.

9. Apparatus as recited in claim 8 wherein said movement responsive means includes cam means carried by said spring member.

10. Apparatus for trimming a lateral edge of a moving continuous sheet comprising hold down means selectively movable between a covering position disposed over the lateral edge of the sheet and a spaced position away from the lateral edge of the sheet;

cutting means carried on said hold down means and selectively movable between an inoperative position and an operative position extending from said hold down means to contact the lateral edge of the sheet for trimming the lateral edge from the sheet when said hold down means is in said covering position; and latch means for locking said cutting means in said operative position with said hold down means in said covering position and, responsive to movement of said hold down means from said covering position, for unlocking said cutting means to allow said cutting means to return to said inoperative position.

11. Apparatus as recited in claim 10 wherein said latch means includes a member engaging said cutting means and said hold down means to lock said cutting means in said operative position and being movable out of the engagement with said cutting means when said hold down means is moved from said covering position.

12. Apparatus as recited in claim 11 and further including means for pivotally mounting said hold down means, and means offset from said pivotal mounting means for mounting said member.

13. Apparatus as recited in claim 12 wherein said cutting means includes a flat blade having an angled cutting edge.

14. Apparatus for trimming apertured lateral edges from a continuous sheet after printing comprising drive means having teeth for engaging the apertured lateral edges of the sheet, hold down means pivotally mounted to be movable between a covering position adjacent said drive means and a position spaced from said drive means, said hold down means having an opening therein aligned with said teeth of said drive means when said hold down means is in said covering position; and cutting means carried by said hold down means laterally spaced from said opening including a cutting edge selectively movable between an inoperative position above said hold down means and an operative position extending beneath said hold down means to trim the apertured lateral edges of the sheet as the sheet is moved by said drive means.

15. Apparatus as recited in claim 14 further comprising bias means for urging said cutting means to said inoperative position and latch means locking said cutting means in said operative position and responsive to pivotal movement of said hold down means from said covering position to said spaced position to unlock said cutting means to allow said bias means to return said cutting means to said inoperative position.

* * * * *